US006764349B2

(12) United States Patent
Provencher et al.

(10) Patent No.: US 6,764,349 B2
(45) Date of Patent: Jul. 20, 2004

(54) MATRIX CONNECTOR WITH INTEGRATED POWER CONTACTS

(75) Inventors: Daniel B Provencher, Nashua, NH (US); Thomas S. Cohen, New Boston, NH (US); Philip T. Stokoe, Attleboro, MA (US)

(73) Assignee: Teradyne, Inc., Boston, MA (US)

( * ) Notice: Subject to any disclaimer, the term of this patent is extended or adjusted under 35 U.S.C. 154(b) by 0 days.

(21) Appl. No.: 10/113,203

(22) Filed: Mar. 29, 2002

(65) Prior Publication Data

US 2003/0186595 A1 Oct. 2, 2003

(51) Int. Cl.[7] ..... H01R 13/502
(52) U.S. Cl. ..... 439/701; 439/608; 439/947
(58) Field of Search ..... 439/701, 74, 608, 439/609, 947

(56) References Cited

U.S. PATENT DOCUMENTS 4,806,107 A * 2/1989 Arnold et al. ..... 439/79
5,500,788 A * 3/1996 Longueville et al. ..... 361/800
5,582,519 A * 12/1996 Buchter ..... 439/101
5,993,259 A * 11/1999 Stokoe et al. ..... 439/608
6,102,747 A * 8/2000 Paagman ..... 439/701
6,146,202 A 11/2000 Ramey et al. ..... 439/608
6,171,149 B1 * 1/2001 van Zanten ..... 439/608
6,196,853 B1 * 3/2001 Harting et al. ..... 439/79
6,293,827 B1 * 9/2001 Stokoe ..... 439/608
6,530,790 B1 * 3/2003 McNamara et al. ..... 439/108
6,540,522 B2 * 4/2003 Sipe ..... 439/61

FOREIGN PATENT DOCUMENTS

EP 0 337 034 10/1989

* cited by examiner

*Primary Examiner*—Tho D. Ta
*Assistant Examiner*—Larisa Tuskerman
(74) *Attorney, Agent, or Firm*—David H. Hwang; Teradyne Legal Dept.

(57) ABSTRACT

An electrical connector system suitable for use in a matrix assembly. The electrical connector assembly has two connectors, each assembled from wafers. Certain of the connectors include a combination of signal and power conductors while others have only signal conductors. In this way, the signal density is maximized.

12 Claims, 13 Drawing Sheets

Application No. 10/113,203
July 25, 2003
Replacement Sheet

Application No. 10/113,203
July 25, 2003
Replacement Sheet

Application No. 10/113,203
July 25, 2003
Replacement Sheet

MATRIX CONNECTOR WITH INTEGRATED POWER CONTACTS

This invention relates generally to electronic assemblies and more specifically to electrical connectors for routing signals between printed circuit boards in an electronic assembly.

Electronic systems are often assembled from several printed circuit boards. These circuit cards are sometimes referred to as "daughter boards." The daughter boards are held in a card cage. Electrical connections are then made between the daughter boards.

One traditional approach is to interconnect the daughter cards using a backplane. The backplane is a large printed circuit board with few, if any, active components attached to it. Mainly, the backplane contains signal traces that route electrical signals from one daughter card to another. It is mounted at the back of the card cage assembly and the daughter cards are inserted from the front of the card cage. The daughter cards are in parallel to each other and at right angles to the backplane.

For ease of assembly, the daughter cards are connected to the backplane through a separable connector. Often, two-piece electrical connectors are used to join the daughter cards to the backplane. One piece of the connector is mounted to each of the backplane and a daughter card. These pieces mate and establish many conducting paths. Sometimes, guide pins are attached to the backplane that guide the daughter board connector into proper alignment with the backplane connector.

A two piece electrical connector has contacts in each piece of the connector that are adapted to make electrical contact when the two pieces mate. A traditional backplane connector has contacts that are shaped as pins or blades and the daughter card contact has contacts that are shaped as receptacles. Each pin is inserted into a receptacle when the connectors mate.

To make a high speed, high density connector, shielding is often added to the connectors. U.S. Pat. No. 5,993,259 to Stokoe, et al. represents a desirable shielding design and is hereby incorporated by reference. Teradyne, Inc., the assignee of that patent markets a connector called VHDM® that is commercially successful. Interconnection systems often employ power connectors along with signal connectors. In this way, power is transmitted from the backplane to the daughter cards to power the circuitry on the daughter cards. U.S. patent application Ser. No. 09/769,867 entitled "Waferized Power Connector" filed Jan. 25, 2001 by Cohen et al., (which is hereby incorporated by reference) describes a waferized power connector that is suitable for use in an assembly with signal connectors. Teradyne, Inc., the assignee of that patent markets a connector called GbX™ that is commercially successful.

Not all electronic assemblies employ a backplane. Some use a midplane configuration. In a midplane configuration, daughter cards are inserted into both the front and the back of the card rack. Another printed circuit board, called the midplane, is mounted in the center of the card cage assembly. The midplane is very similar to a backplane, but it has connectors on both sides to connect to the daughter boards inserted from the front and the back of the assembly.

A further variation is called a matrix configuration. In the matrix configuration, daughter boards are inserted from both the front and the back of the card cage. However, the boards inserted from the front are perpendicular to the boards inserted from the back. Connectors are mounted at the interconnection of these circuit boards to make connections between the boards.

Currently, there exists no suitable high speed, high density connectors for some matrix configurations. And, there exists no such connector system for a matrix configuration that readily incorporates power connectors.

SUMMARY OF THE INVENTION

With the foregoing background in mind, it is an object of the invention to provide power contacts for a connection system in a matrix configuration.

It is also an object to provide a matrix connector that is easy to manufacture.

The foregoing and other objects are achieved in a connector with two intermateable pieces. Each piece is made from a plurality of subassemblies, with some adapted to provide power connections. In the preferred embodiment, each piece includes both signal and power contacts.

In a preferred embodiment, each connector piece includes both power contacts and signal contacts oriented to provide a generally square component, allowing connector pieces attached to boards oriented orthogonal to each other to mate.

BRIEF DESCRIPTION OF THE DRAWINGS

The invention will be better understood by reference to the following more detailed description and accompanying drawings in which.

DESCRIPTION OF THE PREFERRED EMBODIMENT

Figure 1:
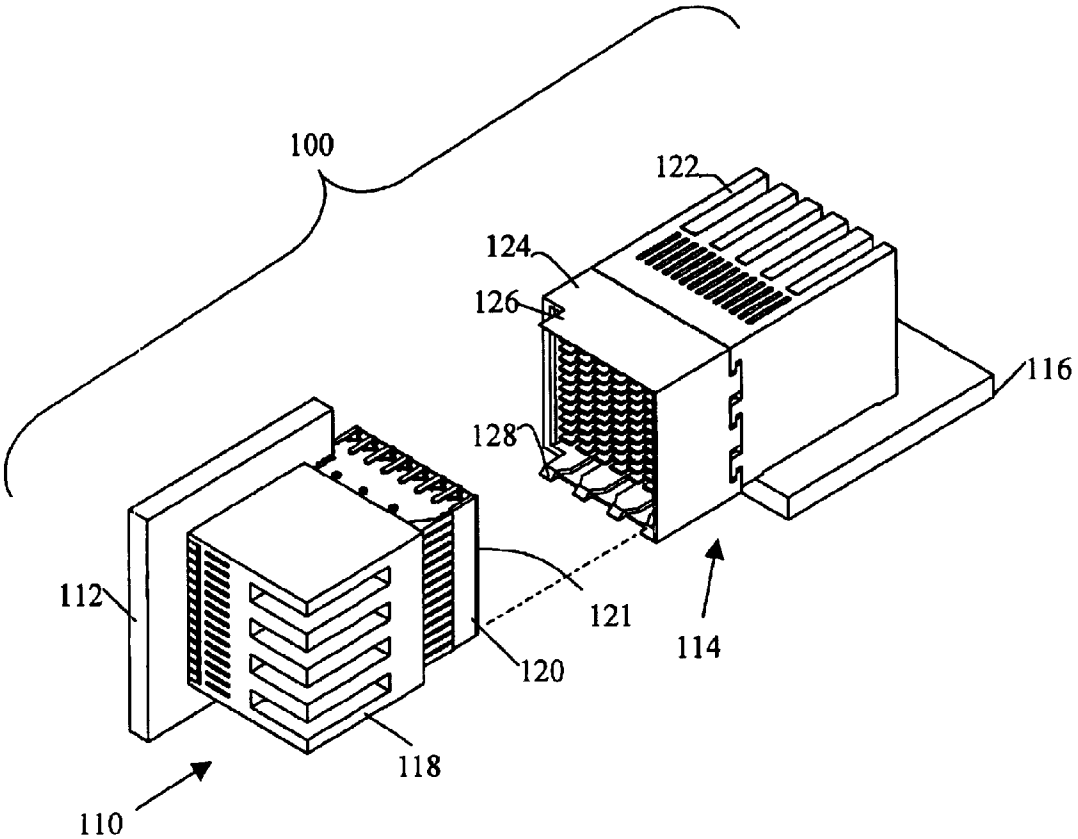
FIG. 1 is a illustration of a matrix assembly according to the invention.

FIG. 1 shows a portion of a matrix assembly 100. Assembly 100 includes a vertical board 112 and a horizontal board 116. A type A connector 110 is mounted to board 112 and a type B connector 114 is mounted to board 116. The connectors 110 and 114 each have numerous signal and ground contact tails 230, 330 that make electrical connection to circuit traces on or within the boards 112, 116 (see FIGS. 2 and 3). Additionally, each of the connectors 110, 114 have conducting elements with mating portions 232 (FIG. 2) and 832 (FIG. 8). The mating portions are positioned so that when the type A connector and the type B connector are mated, numerous circuit paths will be completed between board 112 and board 116.

In the illustrated example, boards 112 and 116 are conventional printed circuit boards as traditionally found in a matrix assembly. It will be appreciated that only very small boards are shown. In a commercial implementation, each board would be larger and contain numerous electronic devices.

Also, it should be appreciated that a commercial embodiment of a matrix assembly is likely to have more than just two boards. For example, a matrix assembly is more useful when multiple horizontal boards are connected to the same vertical board. In this way, the vertical board can route electrical signals between the horizontal boards. A matrix assembly is likely to be even more useful if multiple vertical boards are included along with multiple horizontal boards. In this way, a system designer has significant flexibility in routing signals between printed circuit boards.

In the embodiment illustrated in FIG. 1, type A connector 110 includes a housing 118 and a cap 120. As will be described in greater detail below, the connector 110 is made up of a plurality of subassemblies or wafers (e.g., 310 of FIGS. 3 and 8A) that contains signal conductors.

Housing 118 holds the rear portions of the wafers. In the illustrated embodiment, housing 118 is an insulative housing, preferably made of plastic or other material typically used in the manufacture of electrical connectors.

Cap 120 is also made of insulative material in the illustrated embodiment. Cap 120 provides the mating face of type A connector 110. It positions the contact portions of the conductive members inside the connector and also protects them from physical damage.

Cap 120 further aids in providing "float" or "compliance." Cap 120 includes features, such as tapered surface 121 that generates force in a direction that tends to align caps 120 and 124 (of type B connector 114) as the two connectors are mated. The compliance mechanism of the connector is described in greater detail below.

Likewise, type B connector 114 includes a housing 122 and a cap 124. As with the type A connector, housing 122 holds wafers (210 of FIG. 2) in position. Cap 124 also positions and protects the contact portions of the conductive members inside the connector. Cap 124 includes a shroud, such as formed by projecting walls 126 (see FIG. 1), to protect the contacts.

The shroud also serves to provide alignment between the type A and type B connectors as they mate. In the illustrated embodiment, cap 120 fits within the shroud. When cap 120 is engaged in the shroud, the contact elements from the type A connector align with the contact elements in the type B connector.

To further help with the alignment, walls 126 include alignment features 128. Alignment features 128 engage with complementary alignment features on cap 120 to aid in guiding the connectors into a mating position. Preferably, the alignment features have tapered surfaces, such as 130 (FIG. 2), to guide the front face of the connectors into the appropriate position in the Y direction. Tapered surfaces 132 (FIG. 2) engage complementary features on the mating connector to guide the connectors into appropriate alignment in the X direction. In the illustrated embodiment, cap 124 is compliant and pressing a mating connector into cap 124 aligns cap 124 with the mating connector.

Figure 2:
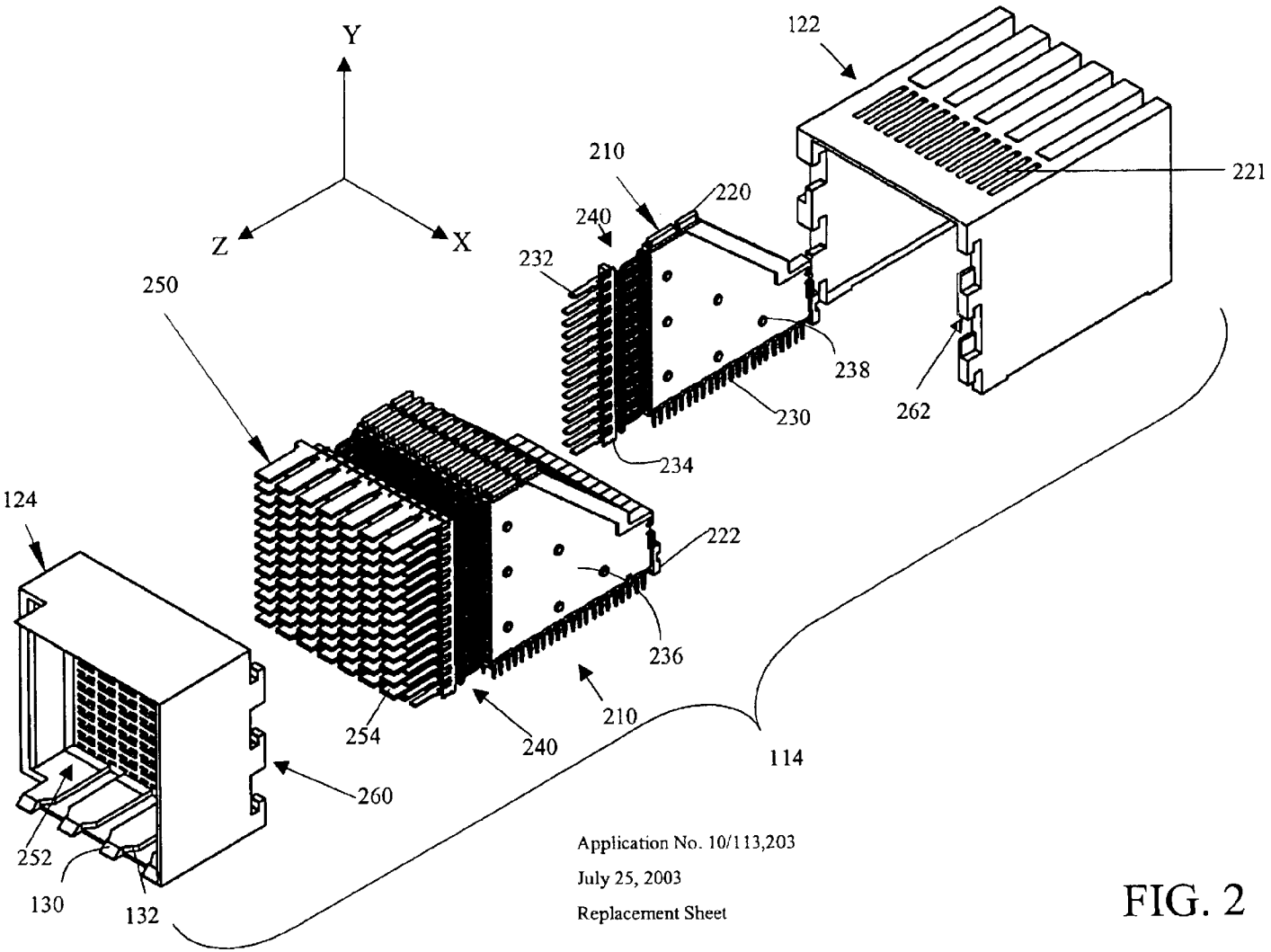
FIG. 2 is an exploded view of a first type connector of FIG. 1.

The type B connector 114 is shown in exploded view in FIG. 2. A plurality of wafers 210 are shown stacked side by side. The wafers fit within housing 122. In the illustrated embodiment, each wafer contains features, such as 220 and 222, that engage other features within housing 122 to hold the wafers in place.

Various engagement features might be used. In the illustrated embodiment, feature 220 includes a tab that engages a slot 221 on the housing 122. If desired, feature 220 might also include a latch to prevent the wafer from sliding out once engaged. Feature 222 includes a tab or boss or similar protrusion to engage a complementary opening on the inside of housing 122.

Each wafer includes conducting elements. In the preferred embodiment, some of the conducting elements are designed to carry signals. Others of the conducting elements are intended to be connected to ground. The ground conductors also can serve as shields to reduce distortion carried on the signal conductors.

The conducting elements are connected to the printed circuit board 116. Contact tails 230 project from a lower edge of the wafer. In the illustrated embodiment, the contact tails are press fit contacts that engage holes in the surface of a printed circuit board.

The conducting elements also include portions that extend from the forward edge of wafer 210. In the preferred embodiment, the signal conductors extend from the forward edge of the wafer as mating contact portions 232. In FIG. 2, the mating contact portions are illustrated as blades. However, it should be appreciated that multiple forms of mating contacts are known—such as pins, receptacles or beams—and could be used.

The ground conductors in the preferred embodiment take the shape of shield plates 236 that lies flat against the major surface of the wafer. Hubs 238 extend from wafer 210 and pass through holes in plate 236, thereby holding it securely to the wafer.

Ground plate 236 includes contact tails 230 that press fit into ground holes in printed circuit board 116. Ground plate 236 also includes a connection portion that extends from the forward edge of the wafer. The forward edge of ground plate 236 includes contacts 234 that are adapted to mate to shields 250.

As shown in FIG. 2, each of the wafers 210 contains a column of signal contacts. Shield plate 236 shields a column from the column provided by an adjacent wafer in the body of the wafer.

When the wafers are assembled side by side, the columns of signal contacts make a rectangular array of signal conductors. In the illustrated embodiment, the array will be a square array. Each wafer contains a column of fourteen signal contacts and fourteen wafers are aligned side by side to make fourteen rows of fourteen contacts each.

Shields 250 are positioned between the rows of signal contacts in the region of the mating contact portions. Shield plates 250 are electrically connected to the shield plates 236. Each shield plate 250 engages a contact 234 on each of the shields 236 (see FIG. 4C). Much of the length of each signal conductor is adjacent to either one of the shield plates 236 or one of the shields 250. In this way, shielding is provided substantially over the length of the signal conductors.

In between the body of the wafer and the contact portions are compliant portions 240, which is described in greater detail below. These complaint portions allow the portions of the wafer containing the mating contacts to move relative to the rear portion of the wafers. Also, it should be noted that the attachment points of the wafers, such as 220 and 222 are on the rear portions. Thus, while the rear portion of the wafers are fixed to the housing and to the printed circuit board, the mating contact portions can move relative to the board and the housing. In the preferred embodiment, the compliant portions adjusts for mis-alignment between the mating pieces of the connectors.

The shield plates 250 fit into the cap 124 and are secured with any convenient means. For example, each edge of the shield plates 250 might fit into a slot in a wall of cap 124. However, in the illustrated embodiment, cap 124 has a floor 252 that includes numerous openings. Each shield plate 250 is cut with slits creating fingers 254. Each of the fingers projects through an opening in floor 252, creating a mating surface within the shroud created by the walls 126 of cap 124. In the illustrated embodiment, the shield plates are held firmly to the cap through an interference fit.

Mating portions 232 project through openings in floor 252. Preferably, the openings are so small that they create an interference fit with the mating portions 232 to secure them to cap 124. Likewise, they are situated to provide a mating area within shroud created by the walls 126 of cap 124.

In the preferred embodiment, cap 124 is not rigidly attached to housing 122. A means of attachment is used to provide compliance to cap portion 124. Because there is compliance in cap portion 124, there is also compliance in the mating area within cap 124. Significantly, if the connectors 110 and 114 are misaligned, the compliance allows the mating contacts of each connector to properly align nonetheless.

In the illustrated embodiment, the compliance is provided with attachment features 260 on cap 124 and attachment features 262 on housing 122 that allow a sliding form of attachment in combination with compliance sections 240 on all of the conductors. Preferably, the specific form of attachment allows the cap to move in the plane illustrated as the X-Y plane in FIG. 2. It is also preferable that the attachment not allow compliance in the direction illustrated as Z. As the connector pieces 110 and 114 are pushed together for mating, it is desirable that the mating portions come into alignment in the X-Y plane. A rigid attachment in the Z direction is desirable so that sufficient mating force can be generated.

As described above, the electrical conductors have portions that are rigidly attached to the printed circuit board 116. They also have portions that are attached to cap 124. But, these two portions are separated by compliant portions 240. In this way, electrical connections can be made through the connector while still providing the compliance necessary to ensure proper mating.

Figure 3:
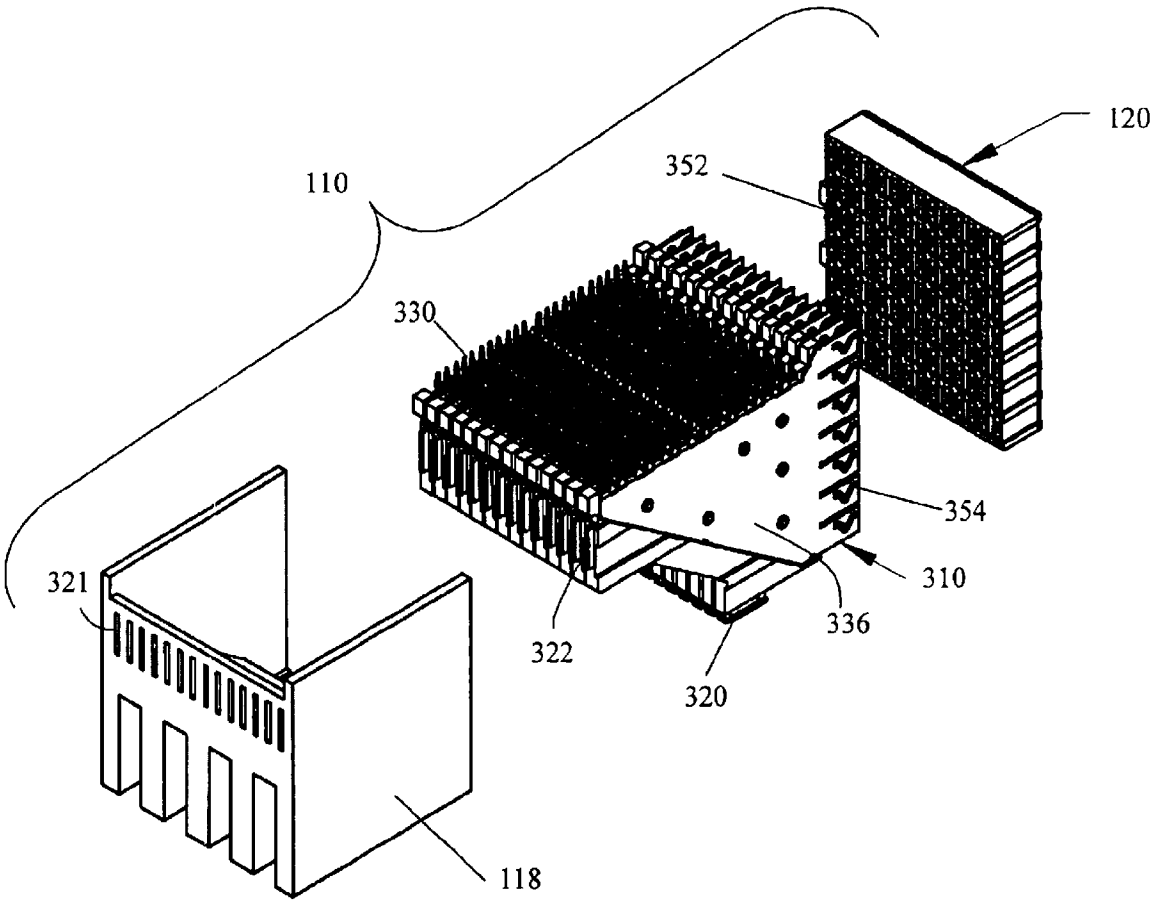
FIG. 3 is an exploded view of a second type connector of FIG. 1.

Turning now to FIG. 3, type A connector 110 is shown in exploded view. The connector contains a plurality of wafers 310. As with wafers 210, wafers 310 include a plurality of signal conductors and a shield 336. A plurality of contact tails 330 extend from a lower surface of the wafers for attachment to printed circuit board 112.

Wafers 310 are stacked side-by-side, with their major surfaces in parallel. The wafers are secured to housing 118. Attachment features 322 on the wafers 310 engage slots 321 in the housing 118. Likewise, features 320 engage other slots in housing 118.

In the illustrated embodiment, each wafer includes fourteen electrically separate conductors that are intended to act as signal conductors. Fourteen wafers are stacked side by side to make a rectangular array with the same number of rows and columns. And, as with the type B connector 114, the pitch between the contacts in a wafer is the same as the spacing between adjacent wafers. Thus, despite the fact that the wafers in the type A connector 110 and the wafers in the type B connector 114 are orthogonal, each connector has a mating interface with contacts in a rectangular array with contact spacings that allows the conductors to mate.

The conductors of wafers 310 have mating portions that extend at the forward edge of the wafer. In the preferred embodiment, these mating portions fit within recesses formed in the lower surface 352 of cap 120. As in a traditional connector, the recesses within cap 120 are accessible through openings in the mating face of cap 120. As connector 110 is mated with connector 114, cap 120 fits within the walls of cap 124, bringing the mating contact portions of the conductors from connector 110 into the mating area. The mating portions of the signal conductors from connector 114 pass through the openings in the mating face of cap 120 and make electrical contact with the mating contact portions of the conductors from connector 110.

In the illustrated embodiment, the mating contact portions of the signal conductors of connector 114 are blades. The mating contact portions of the signal conductors from connector 110 must be of the type that makes a suitable electrical connection to a blade. Preferably, the mating contact portions of the signal conductors in connector 110 will include one or more beams bent in such a way to generate spring force against that blade. Preferably, two separate beams positioned in parallel to create a split beam type contact create the mating contact portion of the signal conductors in connector 110.

The mating contact portions for the ground conductors in connector 114 are the fingers 254. Fingers 254 also provide a blade-like mating contact portion. As can be seen in FIG. 3, shields 336 also have fingers 354 in their mating areas. However, rather than being completely flat, fingers 354 have beams 830 (FIG. 8) cut in them. In the illustrated embodiment, the beams are secured to the shield plate at two ends, but bent out the plane of the shield in the middle. This arrangement allows the beams to generate a spring force.

During mating, fingers 254 from one of the shields 250 will be parallel to and adjacent fingers 354 from one of the shields 336. The spring force generated by the beams 830 will create the necessary electrical connection between the shields. In this way, the shields in connector 110 are electrically connected to the shields in connector 114.

Turning now to FIG. 4, a manufacturing process for wafer 210 is illustrated. FIG. 4A shows a lead frame 410. The lead frame 410 is stamped from a sheet of conductive material of the type traditionally used to make signal contacts in an electrical connector. Preferably, a copper alloy is used.

When lead frame 410 is stamped, carrier strips 412 are left to allow easier handling of the lead frame. The lead frame is held to the carrier strip 412 by a plurality of tie bars 414. And, the signal conductors 416 are joined by tie bars 415. The tie bars 415 are eventually cut to leave a plurality of electrically separate signal contacts 416. And the tie bars 414 are eventually cut to separate the wafer 210 from the carrier strips.

As can be seen, each signal contact has a contact tail 230, a mating contact portion 232, a compliant portion 240 and an intermediate portion, between the compliant portion and the contact tail.

In a preferred embodiment, multiple lead frames are stamped from a long strip of conductive material. The lead frames are joined by the carrier strips 412 and wound on a reel (not shown). In this way, an entire reel of wafers 210 can be processed and easily handled. However, for simplicity, only a portion of the reel is shown.

Once the lead frame 410 is stamped to the required shape, a forming operation might be used. The forming operation creates any features on the lead frame 410 that are out of the plane of the sheet of material used to make the lead frame. The precise shape and amount of forming will depend on the design of the signal contact. In the illustrated embodiment, the mating contact portions 232 are bent at a 90° angle relative to the plane of the lead frame 410. This bend places the smooth, flat surface of the contact portion perpendicular to the plane of lead frame 410. In use, the mating contact portion from the connector 110 will press against the flat surface of the contact portion 232 when bent at this angle. It is preferable to have the contacts mate on a smooth surface.

Figure 4B:
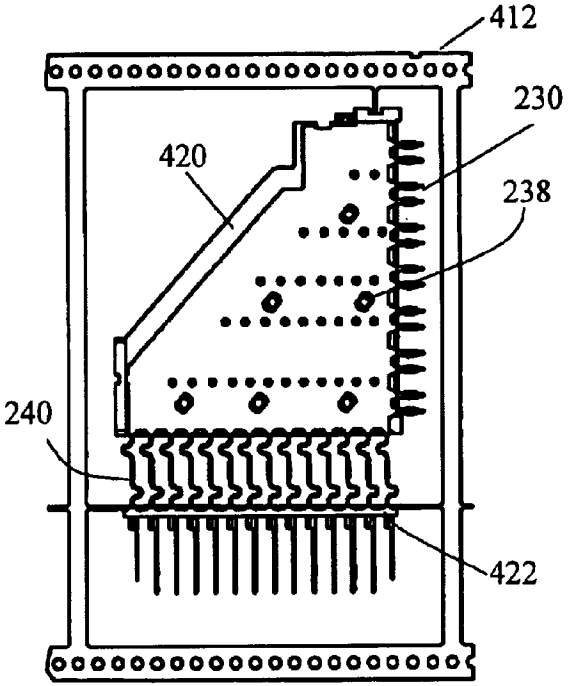
FIGS. 4A–4D is a series of figures showing steps in the manufacturing process of a wafer of FIG. 2.

FIG. 4B illustrates another step in the manufacture of the wafer 210. The lead frame is placed in a mold and an insulator 420 is molded around the intermediate portions of the signal conductors. Insulator 420 locks the signal conductors 416 in place. It also provides mechanical support to the wafer 210 and insulates the signal conductors to avoid electrical shorts. Insulator 420 might be any suitable plastic, such as those which are traditionally used in the manufacture of electrical connectors.

Insulator 420 is shown with a plurality of hubs 238 molded therein for later attachment of a shield. The surface of insulator 420 is molded to receive the shield 236.

FIG. 4B also shows a forward insulator 422 molded across the signal conductors at the proximal end of the signal contacts 232. Forward insulator holds the signal contacts together when the tie bars are severed. It also provides a point of attachment for a manufacturing tool that can be used to press the signal contact portion of the wafers into cap 124.

Figure 4A:
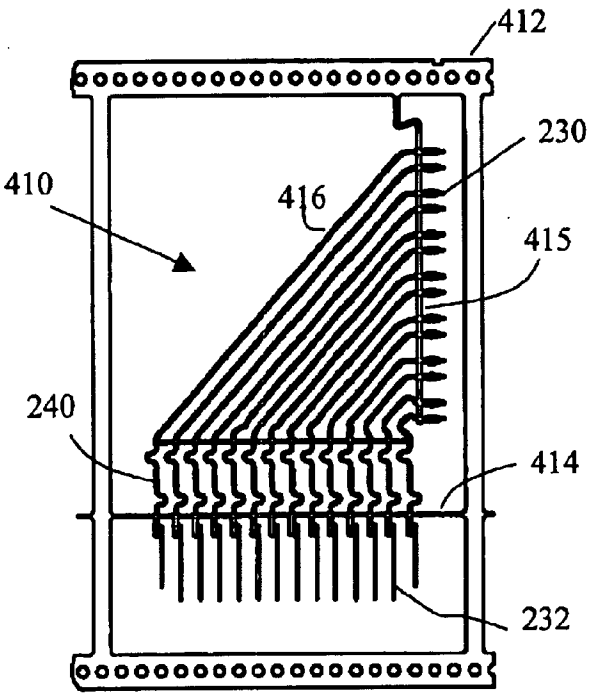
Figure 4D:
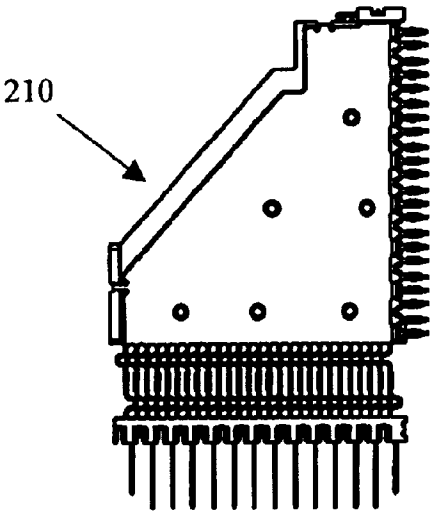
Figure 4C:
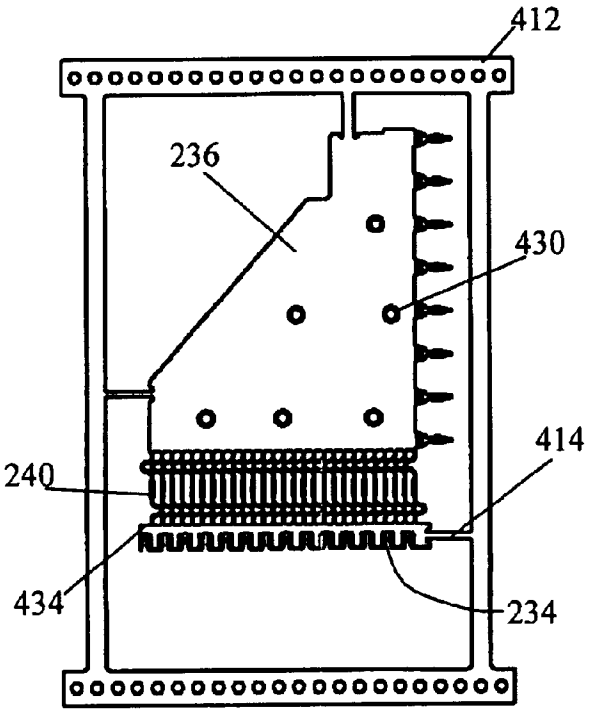

FIG. 4C shows a shield 236 before attachment to wafer 210. As with the signal contacts, a plurality of shields are stamped from a sheet of conductive material and held together on carrier strips. Shield 236 is stamped with a plurality of holes 430 to engage the hubs 238. The positioning of holes 430 and hubs 238 holds a generally planar intermediate portion adjacent the insulator 420.

Shield 236 is also stamped with a plurality of compliant portions 240, extending from the intermediate portion. In the illustrated embodiment, there are approximately the same number of compliant portions 240 on each shield 236 as there are signal conductors in the wafer. This number of compliant portions provides for an appropriate flow of ground current and also the appropriate amount of compliance. More complaint portions 240 additionally provide greater shielding.

A forward portion 434 extends from the compliant portions 240. Forward portion 434 is secured to cap 124. Shield contacts 234 are formed on forward portion 434.

As with the signal contacts, the shield 236 might be formed after stamping to provide features that extend out of the plane of the conductive sheet used to make the shield. Contact portions 230 also extend from the intermediate portion of shield 236 and can be formed.

FIG. 4D shows wafer 210 at a later stage of assembly. A shield plate 236 is overlaid on the insulator 420. The shield plate is pressed to engage the hubs 238 in holes 430. The tie bars 414 are cut to release wafer 210 from the carrier strips 412. Wafer 210 is then ready for insertion into housing 122.

Other manufacturing operations as known in the art might be included in addition to the ones shown herein. For example, it might be desirable to coin the edges of the signal contact portions 232. Alternatively, it might be advantageous to gold plate some of the contact portions.

Figure 5:
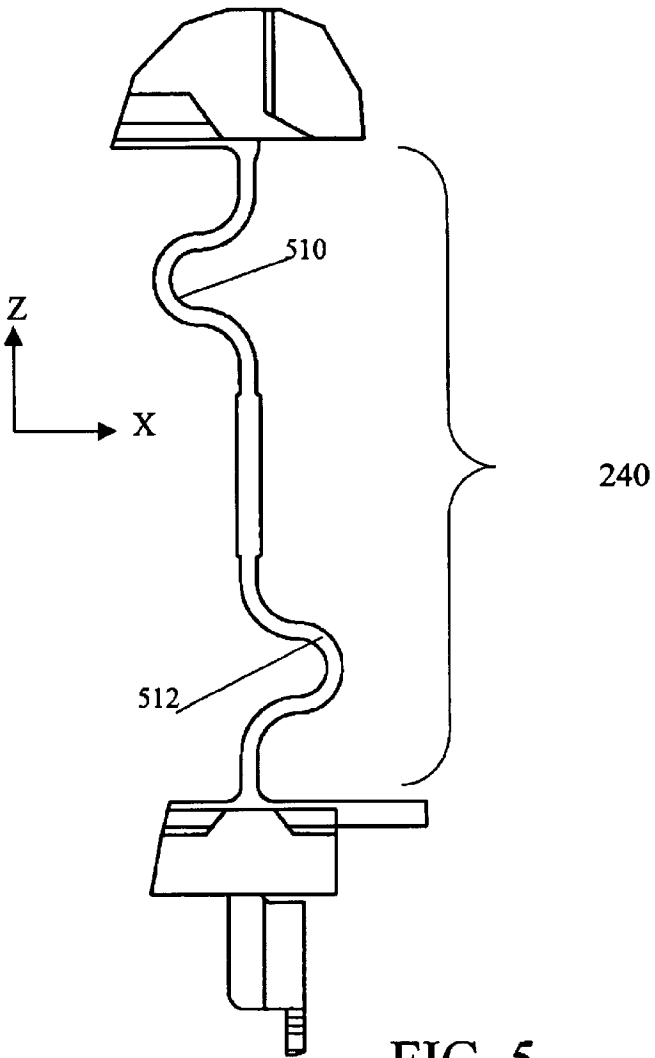
FIG. 5 is an illustration of a preferred embodiment of a compliant section.

FIG. 5 shows additional details of a compliant portion 240. As can be seen, the compliant portion is generally elongated. However, in the illustrated embodiment, the compliant portion includes bends to increase the amount of compliance. In the illustrated embodiment, bends 510 and 512 are included. Preferably, bends 510 and 512 bend in opposite directions to provide compliance in the X and Y directions, without permanent deformation of the contact, thereby providing a self-centering feature to the connector. The number, size and shape of the bends could be varied. However, it is preferable that the compliant portion include smooth bends to provide more desirable electrical properties. In addition, the curved portions additionally provide compliance in the Z direction. While it is generally preferred that the caps engage to preclude motion in the Z direction, there will be some manufacturing tolerances that allow some motion in that direction.

In the preferred embodiment, the compliant portions are approximately 8 mm long made from material with a cross section that is approximately 8 mils square. The amount of compliance can be increased by increasing the length of the compliant section or increasing the radius or number of curved portions. Conversely, if less compliance is needed, the curves would be removed, the segments shortened or a thicker material might be used.

Figure 6B:
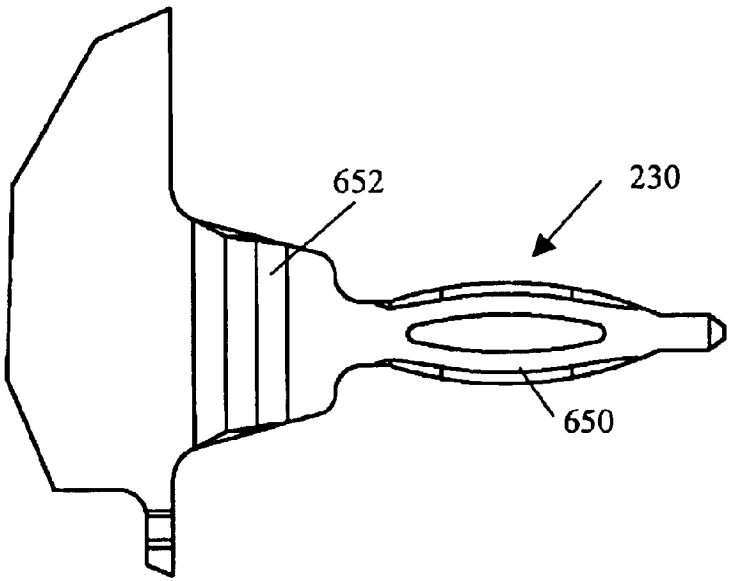
FIGS. 6A and 6B are illustrations showing additional details of features on the shield of FIG. 4C.
Figure 6A:
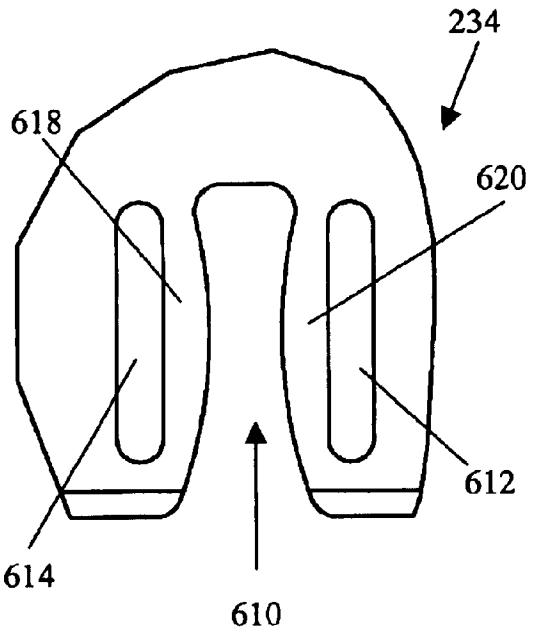

Turning to FIG. 6, additional details of features of shield 236 are shown. FIG. 6A shows a contact 234. The contact is stamped into forward portion 434. A gap 610 is provided. Slots 612 and 614 are also stamped in the shield, leaving beams 618 and 620.

Gap 610 is narrower than the thickness of a shield 250. Thus, as shield 250 is pressed into the gap 610, beams 618 and 620 will be deformed back into slots 612 and 614. However, beams 618 and 620 will generate a substantial amount of force against shield 250. Preferably, the amount of force is sufficient to create a gas tight seal between shield 250 and shield 236.

Turning to FIG. 6B, details of contact tail 230 on shield 236 are shown. In the preferred embodiment, contact tail 230 includes a press-fit portion 650. Tab 652 joins press fit portion 650 to the intermediate portion of shield 236. Here, tab 652 has been bent out of the plane of the intermediate portion of shield 236. The bend aligns the press fit portion 650 with the press fit sections of the signal conductors.

FIG. 4A shows that the contact tails 230 of the signal conductors 416 are grouped in pairs with a gap in between each pair. When shield 236 is installed on a wafer 210, each of the contact tails for the shield 236 will fit between an adjacent pair of signal conductors.

Figure 7A:
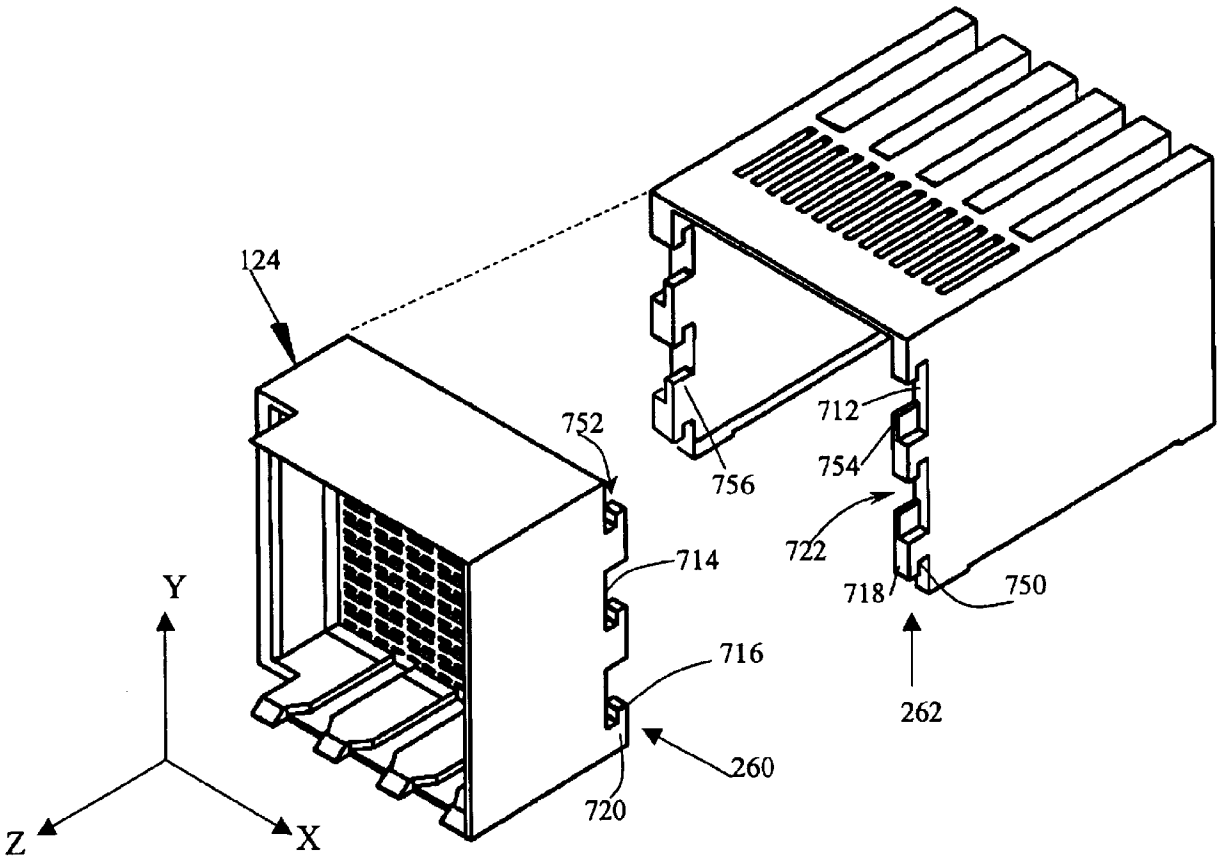
FIGS. 7A and 7B are sketches showing additional detail of the compliant attachment of the preferred embodiment.
Figure 7B:
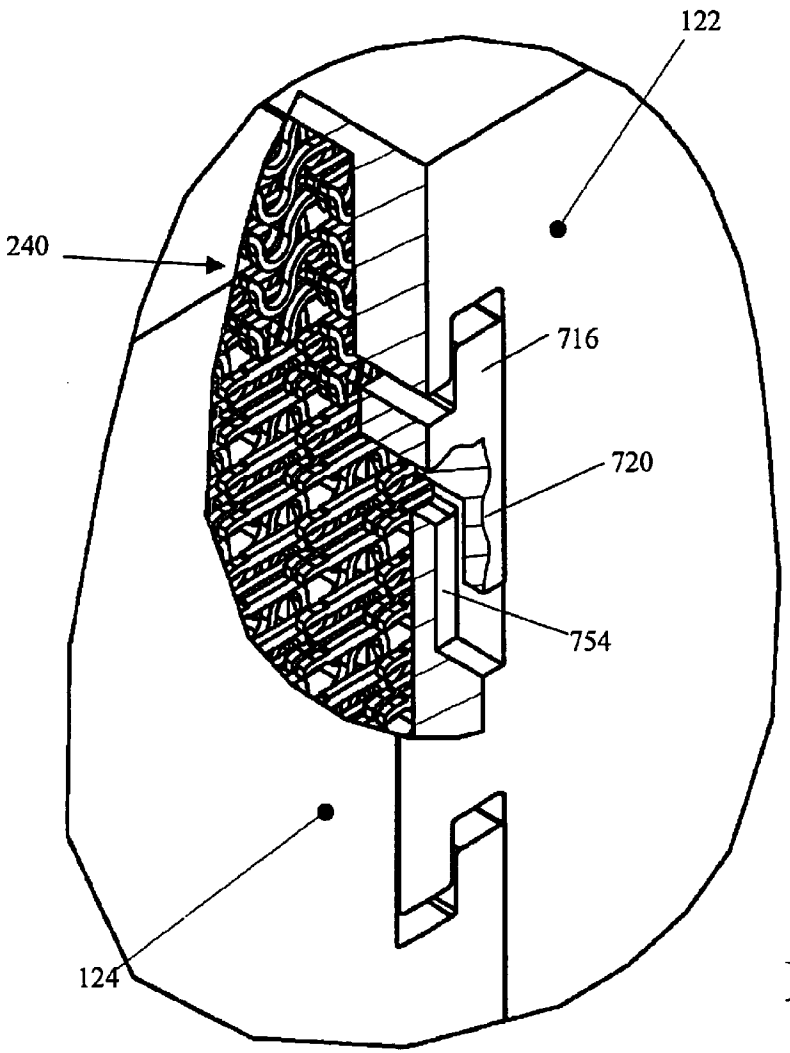

Turning now to FIG. 7, additional details of the compliant attachment between cap 124 and housing 122 are shown. In the illustrated embodiment, the attachment features are on two opposing sides of the housing 122. There are three sets of attachment features 260 and 262 aligned to engage.

Feature 260 includes a tab 716 held away from the surface 714 of cap 124 by a projection 720. This arrangement creates a slot 752 between surface 714 and lip 716.

Feature 262 includes an opening 722 with a rear wall 712. A lip 718 extends into the opening 722 a distance spaced from rear wall 712. This arrangement creates a slot 750 between rear wall 712 and lip 718.

In a preferred embodiment, slot 752 is the same thickness as the width of lip 718 and slot 750 is the same width as the thickness of tab 716. Thus, when attachment features 260 and 262 are engaged, tab 716 is held in slot 750 and lip 718 is held in slot 752. Neither has sufficient play to move a significant amount in the Z direction.

However, the fit should not be so tight as to create an interference fit that precludes all movement. Tab 716 should be able to slide in the X-Y direction within slot 750 and lip 718 should be able to slide in the X-Y direction in slot 752.

Attachment features 262 includes stops that prevent cap 124 from sliding so far as to become disengaged from housing 122. Stop 754 prevents excessive motion to the left in FIG. 7A. Stop 756 prevents excessive motion to the right in FIG. 7A. Up motion is restrained by lip 718 pressing against projection 720. Down motion is restrained when an alignment feature 260 presses against the alignment feature 262 below it.

However, as shown more clearly in the partially cut away view of the engaged alignment features, there is sufficient play between the features 260 and 262 to allow motion in the X-Y plane. For example, projection 720 is made narrow enough to provide 0.5 mm of movement before either stop 754 or 756 is engaged. And, slot 752 is long enough to allow 0.5 mm of movement before lip 718 engages tab 716 or attachment feature 260 bottoms on the attachment feature 262 below it. To provide this amount of compliance, the compliant portions are made approximately 8 mm long of material that is approximately 8 mils square.

Turning to FIG. 8, details of a wafer 310 are shown. As with wafer 210, wafer 310 is preferably made by first embedding a lead frame containing signal contacts in an insulator 820 to make a signal contact subassembly. The lead frame is stamped from a sheet of conductive metal and then formed into the desired shape. In the illustrated embodiment, mating contact portions 832 are formed into split beam type contacts by first stamping two beams and then bending the beams to a shape which generates adequate spring force for mating. Once the lead frame is encapsulated in insulator 820, the individual signal contacts are severed.

Figure 8B:
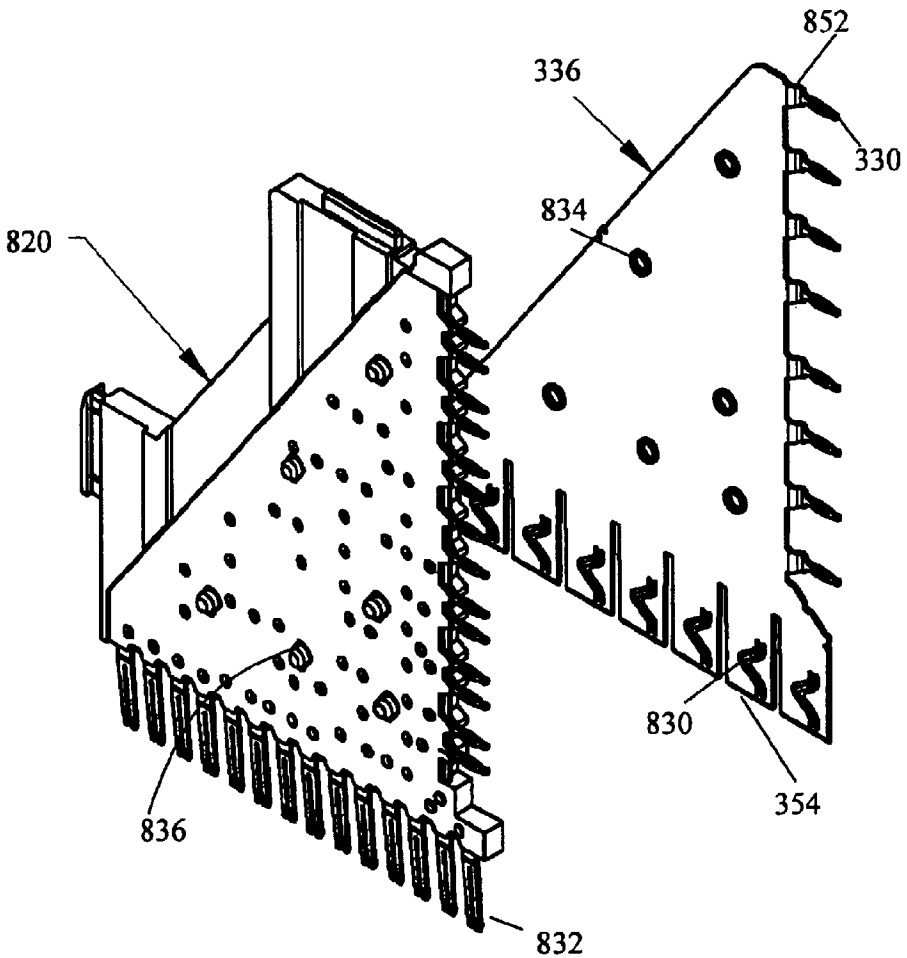
FIGS. 8A and 8B are sketches showing additional details of the wafer of FIG. 3.
Figure 8A:
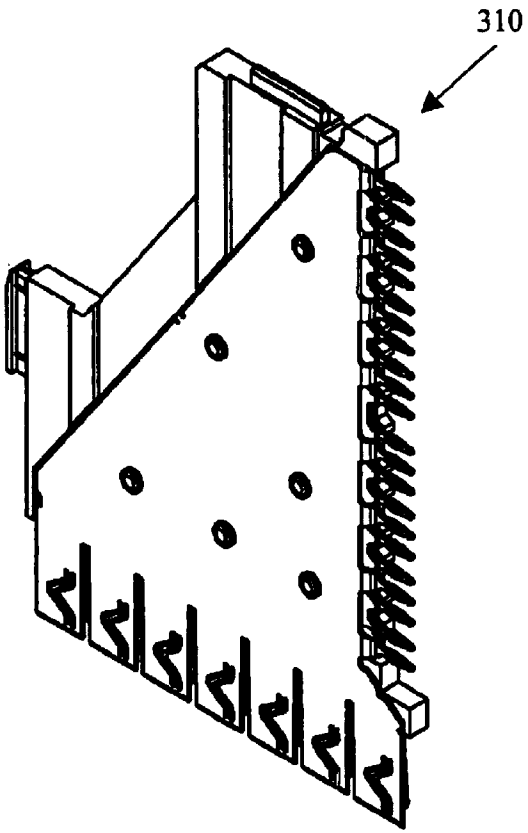

Separately, a shield 336 is stamped and formed. In the preferred embodiment, it is attached to insulator 820 to create a shielded subassembly. Holes 834 engage hubs 836 to hold shield 336 in place. FIG. 8A shows the wafer with the shield attached. FIG. 8B shows the signal contact subassembly and the shield separately.

Shield 336 also has features stamped and formed in it for making electrical connection. A contact tail 330 is attached to a tab 852. Tab 852 is bent such that when shield 336 is attached to insulator 820, the contact tails 330 of the shield 336 are aligned with the contact tails from the signal contacts. As described above, the contact tails 330 are intended to make electrical connection to signal traces within a printed circuit board.

Shield 336 also makes an electrical connection to a shield 250 in a mating connector. A beam 830 is stamped in each finger 354. The beam is bent out of the plane of shield 336 so that, as fingers 354 slide against the shield 250, beams 830 are pressed back into the plane of the shield, thereby generating the required spring force to make an electrical connection between the shields in the mating connectors.

In this way, a connector that is easy to manufacture is provided for a matrix application. Waferized construction is used for both halves of the connector. And, the connector is self-aligning, allowing it to correct for greater positional inaccuracies in the manufacture of the matrix assembly, making it easier to manufacture an electronic system using a matrix configuration of printed circuit boards. A self-aligning connector is particularly important for a matrix assembly because without a single structure, like a back-plane or a midplane, to provide references, there is greater opportunity for manufacturing tolerances of the boards to result in mis-alignment of the connectors. The designs shown herein are capable of mating despite misalignment of over 1 mm.

Furthermore, the design allows for shielding over substantially the full length of the signal contact portions. Shielding adjacent the signal contacts reduces crosstalk between signal conductors. It can also be important to controlling the impedance of the signal conductors.

Figure 9:
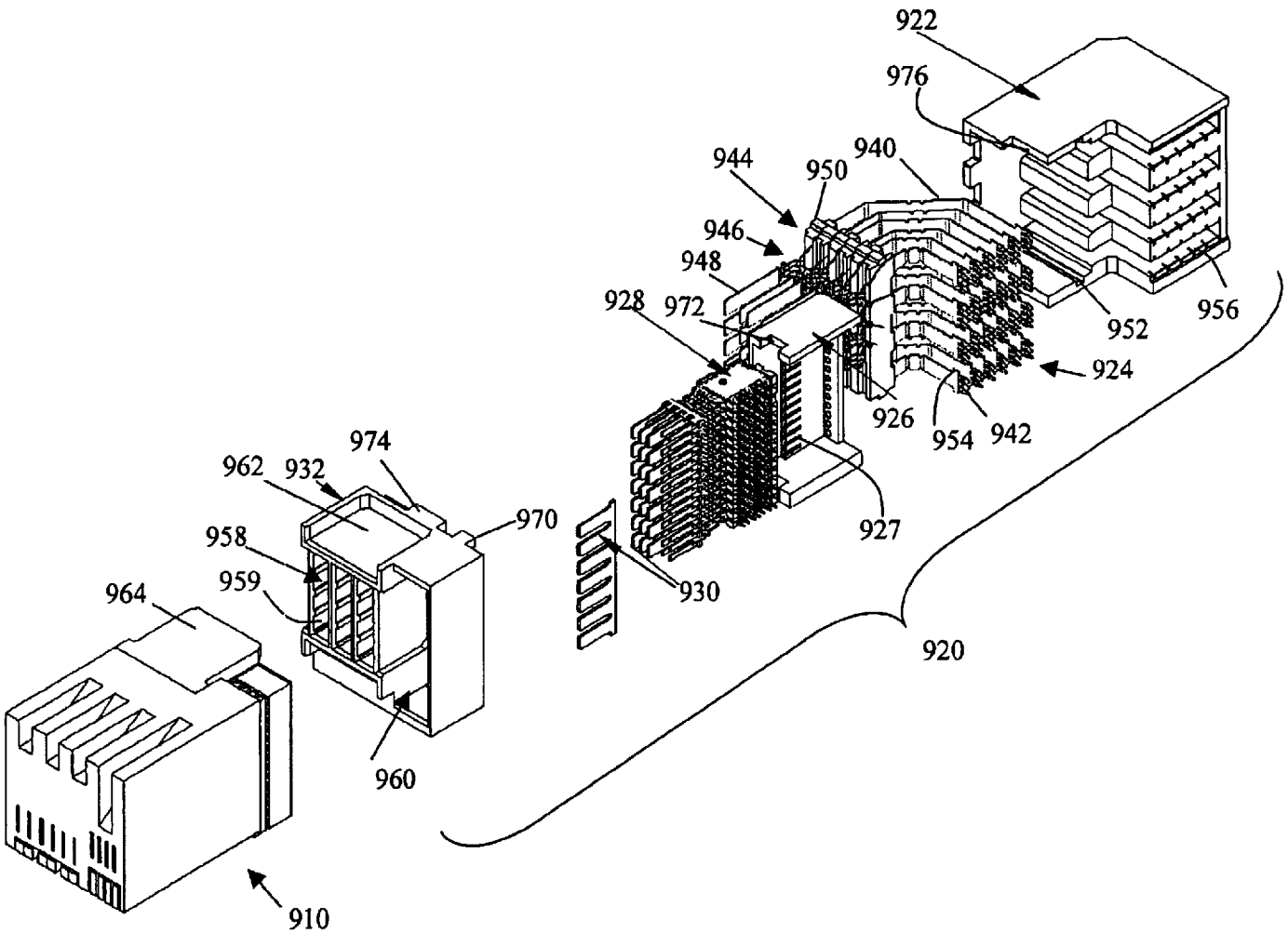
FIG. 9 is a sketch showing a two-piece matrix connector incorporating power contacts with one connector piece exploded.

Turning now to FIG. 9, an alternative configuration of a matrix connector is shown. As above, the matrix connector of FIG. 9 is a two piece connector. However, this connector incorporates power contacts. Power contacts are wider than signal contacts to provide a greater current carrying capacity.

FIG. 9 illustrates the preferred embodiment in which a connector carries both signal and power contacts. In this way, both signals and power can be transmitted from one board to the other, but only as many power contacts as are required to power the board are used. The remaining space in the connector can be used for signal conductors so that the signal density of the interconnection system is maximized.

FIG. 9 shows one connector piece 910, which may be considered a "type A" connector because it is intended to be mounted in the same orientation as the type A connectors illustrated above. The second connector piece 920 is shown in an exploded view, which might be considered a type B connector because it is intended to be mounted in the same orientation as the type B connectors described above. In the preferred embodiment, the connector pieces 910 and 920 will be approximately the same size as connector pieces 110 and 114. In this way, they can be readily incorporated into the same interconnection system as connectors that carry only signal conductors, as shown in FIGS. 1–8.

Connector piece 920 includes a housing 922. Preferably, housing 922 is made of an insulative material, such as plastic. Preferably, housing 922 is molded to the desired shape.

A plurality of power blade assemblies 924 are inserted into housing 922. The number of blade assemblies depends on the amount of power that needs to be routed through the connector. In the example of FIG. 9, each power blade assembly includes four blades in the same space that each signal wafer 210 includes 14 signal contacts. The power blades are therefore much wider, carrying on the order of 5–10 Amperes, depending on the specific shape and material from which they are assembled. Each of the power blade assemblies 924 has four independent blades—which allows each assembly to carry up to four different voltage levels.

The number of power blade assemblies 924 is not important to the invention and will preferably be picked to provide a sufficient current carrying capacity for each level of power required in the system. However, the power blade assemblies do not fill housing 922. Housing 922 also includes signal conductors.

Signal housing insert 926 fits within housing 922. Signal housing insert 926 receives a plurality of signal wafers 928 in wafer attachment features 927. In the illustrated embodiment, the wafer attachment features are slots into which complementary tabs or hubs are inserted.

Signal wafers 928 are formed generally like signal wafers 210. Preferably, they will include the same form of compliant contacts. However signal wafers 928 differ from signal wafers 210 in the number of signal conductors in each wafer. Signal wafers 928 have fewer signal conductors to make them small enough to fit in the space in housing 922 not occupied by the power blade assemblies 924.

Like wafers 210, signal wafers 928 include shields that include contacts along their forward edges like contacts 234.

These contacts allow shields 930 to be connected to signal wafers 928 in the same fashion that shields 250 are connected to wafers 210.

Cap 932 attaches to the mating end of connector piece 920. Cap 932 is compliantly mounted to the housing 922, to provide compliance similar to that provided between cap 124 and housing 122. Attachment feature 970 engages attachment feature 972 on signal housing insert 926. Signal housing insert, because it is attached to the rear portion of the signal wafers which are in turn secured to the printed circuit board, tends to be fixed relative to the circuit board. However, attachment features 970 and 972 allow compliance—at least in the X-Y plane, as defined above. Similarly, attachment features 974 on cap 932 and attachment features 976 on housing 922 also allow compliance.

To align the connector pieces 910 and 920, alignment features are included on the connector pieces. Tab 964 fits within recess 962. As discussed above, these features have tapered surfaces that guide the connectors into alignment. Other surfaces of the connector housing can likewise be tapered to guide the two connectors into alignment.

Each of the power blade assemblies 924 contains several power blades. Each power blade has a rear portion 940. The rear portions contain contact tails 942 that are intended for mounting to a printed circuit board. In the illustrated embodiment, each power contact has three contact tails 942 for greater current carrying capacity. In the preferred configuration, each of the rear portions is bent at a right angle.

The rear portions 940 of the power blades in each power blade assembly 924 is held in a tie bar 944. Preferably, tie bar 944 is an insulative material and might, for example, be insert molded over the power blades. Tie bar 944 holds the power blades together and also provides a manner to attach the power blade assemblies 924 to housing 922.

Each tie bar includes tabs 950 on opposing ends. Tabs 950 slide into slots 952 in housing 922. In this way, the front portion of each of the power blade assemblies 924 is held in the housing. Each of the power blades includes a pair of opposing tabs 954. Each of the power blade assemblies 924 is inserted into housing 922 until the tabs 954 engage slots 956, thereby locking the rear portions 940 of the power blades in housing 922.

Each of the power blades has a compliant portion 946, resembling compliant portion 240, described above. Each compliant portion 946 joins the rear portion 940 to a mating contact portion 948. The compliant portion 946 consists of one or more elongated members. The elongated members might be curved, to provide greater compliance, or straight. The number of elongated members will depend on the specific requirements of the application, such as the amount of current that must be carried and the amount of compliance needed.

The mating contact portions 948 are inserted into power contact cavities 958 of the cap 932. In the illustrated embodiment, mating contact portions form pad type contacts that mate with beams in the opposing connector. Each of the power contact cavities 958 has slots 959 formed in its side walls. Each of the mating contact portions 948 is inserted into one of the slots 959, thereby securing the mating contact portion to cap 932 while exposing a surface of each mating contact portion to the power contact cavity 958.

Cap 932 also includes a signal contact cavity 960. Signal contact cavity 960 resembles cap 124, but sized for the signal wafers 928.

Figure 10:
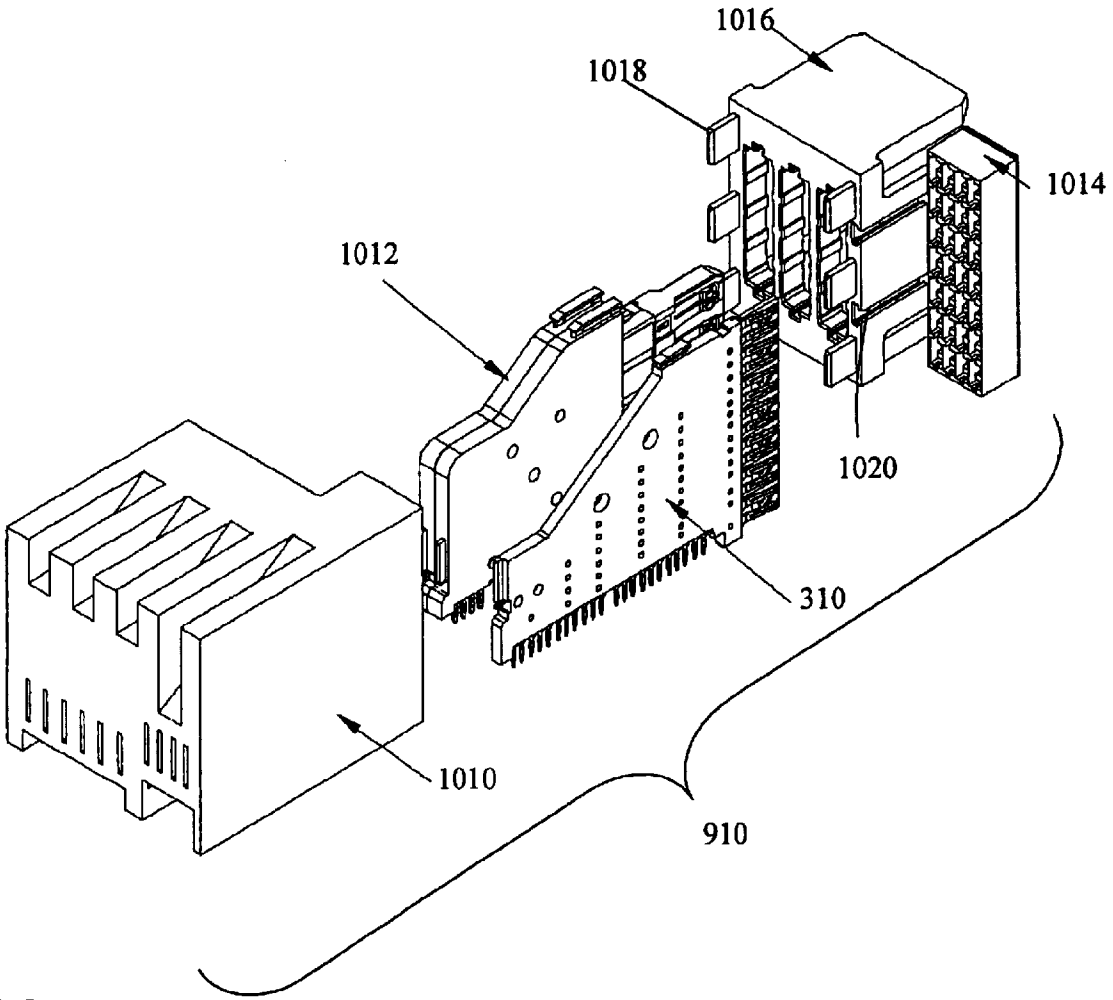
FIG. 10 is a sketch showing a second piece of the matrix connector of FIG. 9 with a second connector piece exploded.

Turning now to FIG. 10, an exploded view of connector 910 is shown. Multiple wafers are held within housing 1010. Preferably, housing 1010 is made of an insulative material, such as plastic. In the preferred embodiment, housing 1010 is molded from plastic.

Both signal and power wafers are inserted into housing 1010. Signal wafers 310 can be the same signal wafers used to make connector 110. Mounting features, such as tabs and slots hold the wafers in housing 1010. Power wafer subassemblies 1012 are also held in housing 1010.

Connector 910 is shown with a two piece cap. Signal cap 1014 has a similar shape and function to cap 120. It is attached to the forward portions of signal wafers 310. However, it has a reduced number of columns because fewer signal wafers are used. In the example of FIG. 10, only four columns are shown.

Power cap 1016 receives the front portions of power wafer subassemblies 1012. Power cap is also attached to housing 1010. Projections 1018 engage complementary features in housing 1010 and might, for example engage with an interference fit or a snap fit.

Power cap 1016 also provides a place of attachment for signal cap 1014. The side wall of power cap 1016 includes slots 1020. T-shaped tabs from signal cap 1014 extend into slots 1020, thereby holding signal cap 1014 against power cap 1016.

Figure 11B:
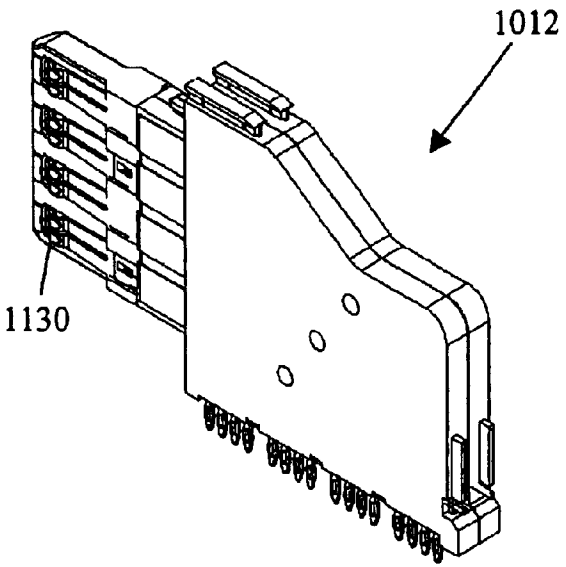
FIG. 11B is a sketch showing the power wafer of FIG. 11A assembled.
Figure 11A:
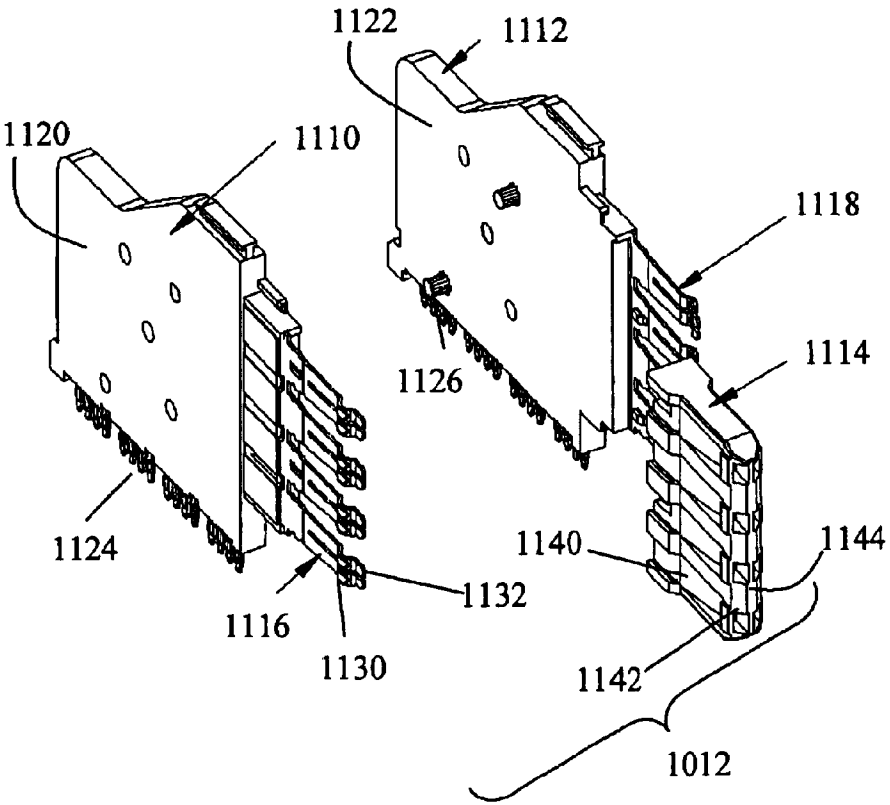
FIG. 11A is a sketch showing a power wafer of the connector of FIG. 10 in an exploded view.

Turning to FIG. 11, details of a power subassembly 1012 are shown. FIG. 11A shows that each power wafer subassembly 1012 is, in the illustrated embodiment, made from two complimentary wafers 1110 and 1112 and a lead insulator 1114.

Each of the power wafers 1110 and 1112 includes power conductors, preferably embedded in an insulator 1120 or 1122. The number of power conductors in each of the power wafers 1110 and 1112 preferably matches the number of blades in each blade subassembly 924. In this way, each of the power conductors can align and mate when connectors 910 and 920 are mated.

Each of the power conductors includes contact tails 1124 that extend from a lower surface of the insulators 1120 and 1122. As with the power subassemblies in connector 920, multiple contact tails are preferably used for each power contact. In the illustrated embodiment, three contact tails for each power conductor are used as a good compromise between current carrying capacity and number of independent power conductors.

Each of the power conductors also includes mating contact portions extending from a forward edge of the insulators 1120 and 1122. In the illustrated embodiment, the mating contact portions are in the shape of bifurcated beams 1116 and 1118 on wafers 1110 and 1112, respectively. Each of the bifurcated beams 1116 and 1118 has a curved portion that curves away from the other wafer that is near the leading edge 1132 of the mating contact portion.

The insulators include features that allow the wafers 1110 and 1112 to be locked together. FIG. 11A shows hubs 1126 extending from a surface of insulator 1122. Hubs 1126 engage complementary openings in insulator 1120. In the illustrated embodiment, hubs 1126 make an interference fit to hold the wafers together. Though other attachment mechanisms, including snap fit, could be used to hold the wafers together.

Lead insulator 1114 fits over the mating contact portions 1116 and 1118. Lead insulator 1114 includes a center wall 1144 that separates the mating contact portions of wafers 1110 and 1112. Center wall 1144 includes grooves 1140 that receive one of the mating contact portions 1118 or 1116. In this way, each of the mating contact portions is insulated from the others.

Lead insulator 1114 can be secured to the rest of the assembly in any convenient way. For example, snap-fit features might hold lead insulator 1114 to insulators 1120 or 1122. Or, an interference fit between portions of the bifurcated beams 1116 and 1118 and the grooves 1140 might alternatively hold lead insulator 1114 in place.

The forward end of each of the grooves 1140 has a lip 1142. The leading edge 1132 of each of the mating contact portions fits under the lip 1142, presenting a smooth leading edge of the power wafer subassembly.

As can be seen more clearly in FIG. 11B, the assembled power wafer subassembly 1012 has curved portions 1130 of each of the power conductors facing outwards. When connectors 910 and 920 mate, the mating contact portions of the 1116 and 1118 will be inserted into power contact cavities 958 where curved portions 1130 will press outwards against mating portions 948 from the power conductors in connector 920. In this way, a separable connection between the two connectors will be formed.

In the illustrated embodiment, each power wafer assembly 1012 has a width approximately three times that of a signal wafer 310. Thus, connector 910 is shown to have three power wafer assemblies 1012 and four signal wafers 310. The outer wall of power cap 1016 adjacent signal cap 1014 also occupies the thickness of approximately one wafer. Thus, connector 910 is shown to have a square mating face of approximately the same size as the mating faces of connectors 110 and 114. In forming an interconnection system, it is often preferable to have connectors, even those of different configurations, to occupy the same space. And, when laying out a matrix interconnection system, it is preferable for the connectors to be square. However, the precise number of power and signal wafers that are in each connector 910 and 920, as well as the connector dimensions can be selected to meet specific design requirements.

Having described one embodiment, numerous alternative embodiments or variations might be made. For example, the orientation of the boards was described as horizontal and vertical. These dimensions are used in the illustration solely to give a frame of reference for the description of the preferred embodiment. In a commercial embodiment, the boards might be mounted with many different orientations driven by the requirements of the electronic assembly. Also, it should be appreciated that the type A and type B connectors need not be mounted on a board with any particular orientation. For example, the locations of the type A and type B connectors might be reversed.

It is also not necessary that the wafers be held in a housing, as shown. An organizer of any type might be used to position the wafers. For example, a metal strip having holes in which to receive features from each of the wafers could be used. Or, the wafers might be held in position by securing the wafers into a block with sufficient rigidity. The wafers, for example, might be held together with adhesive. Likewise, in an application in which the mechanical positioning of the contact tails is not critical, the housing might be eliminated.

As an example of another alternative, it should be appreciated that compliance in a plane was provided in the preferred embodiment by attachment features between cap and housing that allowed motion in two orthogonal directions in the X-Y plane. As an alternative, attachment features that allow compliance in only one direction might be provided with a type B connector. Compliance in the orthogonal direction might be provided by a similar structure on the type A connector—with the combination of the two thereby providing compliance in the plane.

The shield plates are shown in the mating area to be divided into fingers. In the illustrated embodiment, there are half as many fingers as there are signal conductors. In such an arrangement, signal conductors are grouped in pairs adjacent shield fingers. Such an embodiment is useful for making a differential connector in which one signal is carried on a pair of signal conductors. To further enhance the performance of the electrical connector, slits might be cut in the various shield plates. For example, slits might be cut in shields 236 to remove the conducting material between the signal conductors that form a pair carrying a differential signal. Conversely, slits might be cut in shield plates 336 to remove conducting material between the pairs of signal conductors, thereby increasing the electrical isolation between the signals carried by each pair.

Also, it should be appreciated that shields such as 236 are illustrated as having been stamped from a sheet of metal. A shield plate might alternatively be created by a conducting layer on the plastic.

Additionally, contacts 234 are shown with two beams pressing against opposing sides of shield 250. It would be possible to make an electrical contact with a single beam pressing against one side of the shield. Alternatively, it is not necessary that the beams be secured at both ends. A cantilevered beam might alternatively be used.

As another variation, it might be desirable to form cap 124 or cap 932 from a material with greater structural strength than plastic. Because the alignment of the connectors is achieved by forcing the connectors together until the walls of cap 124 or cap 932 guide the cap from the mating connector into position, there can be significant force placed on the walls of caps during mating—depending on the number of conductors in a connector and the degree of misalignment between printed circuit boards. An alternative would be to cast cap 124 or cap 932 from anodized aluminum or otherwise form it from metal. If a conducting metal is used, it would then be necessary to insulate the signal conductors from the metal to avoid shorting the signal conductors. Plastic grommets or other insulator might be inserted in the holes in floor 252 to insulate the signal conductors from the metal. It might also be desirable to insulate the ground plates from the metal.

Also, it should be appreciated that alignment features such as 128 are illustrative of the shape and position of alignment features. More generally, any tapered surfaces that act to urge the connector pieces into proper alignment might be used. And, it is not necessary that the alignment features be formed into the connector pieces themselves. Separate alignment structures, such as alignment pins and holes might be attached to the connector housings or caps.

Further, it is not necessary that the wafers be manufactured by molding plastic over signal contacts. As an alternative way to embed the conductors in the insulator, an insulator might be molded over the shield piece, leaving space for the signal conductors in the insulator. The signal conductors might then be pressed into those spaces and affixed to the insulator. The signal conductors might be affixed to the insulator by using barbs on the signal conductors. Or features could be included in either the conductors or insulators to form an interference fit. Or, an over-molding of insulator might be applied to seal the space around the signal conductors, holding them in the insulator.

Also, it is not necessary that the shields be affixed to the signal subassemblies at all. It would be possible to construct a connector in which loose shield pieces are placed between signal subassemblies.

Another variation might be to place insulating members between adjacent signal conductors or between shield members and signal conductors. For example, shield 336, particularly fingers 354, might be coated with an insulator to prevent contact to signal conductors. Or, forward insulator 422 might be expanded to include openings to receive the contact portions. Thus, rather than insert the contacts into openings in cap 124, the openings would be already molded around the contacts and cap 124 would resemble more of an open frame.

Therefore, the invention should be limited only by the spirit and scope of the appended claims.

What is claimed is:

1. An electrical connector comprising:

a) a support member;

b) a plurality of power conductors within the support member, wherein the power conductors are bent at a right angle thereby bounding two sides of a rectangular area;

c) a plurality of signal wafers connected to the support member, each wafer having a plurality of signal conductors, with the signal wafers stacked in parallel in the rectangular area; and d) each of the signal conductors has a single contact tail extending therefrom and each of the power conductor has at lest three contact tails extending therefrom.

2. An electrical connector comprising:

a) a support member;

b) a plurality of power conductors within the support member, wherein the power conductors are bent at a right angle thereby bounding two sides of a rectangular area;

c) a plurality of signal wafers connected to the support member, each wafer having a plurality of signal conductors, with the signal wafers stacked in parallel in the rectangular area;

d) an insulative cap, the insulative cap having a plurality of cavities therein, wherein each of the plurality of power conductors has a mating contact portion inserted into one of the cavities; and e) each of the cavities has opposing side walls with slots formed therein and wherein the mating contact portions are inserted into the slots leaving a portion of the mating contact portion of each power conductor exposed.

3. An electrical connector assembly having a first electrical connector and a second electrical connector adapted to mate with the first electrical connector, which comprises:

the first electrical connector comprising:

a) a support member;

b) a plurality of power conductors within the support member, wherein the power conductors are bent at a right angle thereby bounding two sides of a rectangular area;

c) a plurality of signal wafers connected to the support member, each wafer having a plurality of signal conductors, with the signal wafers stacked in parallel in the rectangular area;

the second electrical connector comprising:

a) a second support member;

b) a plurality of power wafers aligned in parallel, each of the power wafers having an insulative housing and a plurality of power conductors embedded therein;

c) a plurality of signal wafers aligned in parallel, each of the signal wafers having an insulative housing and a plurality of signal contacts embedded therein;

d) wherein the signal wafers and the power wafers are aligned in parallel; and e) wherein the power wafers are organized in subassemblies, each subassembly comprising two adjacent power wafers, each power wafer having a mating contact portion extending from a forward edge thereof with an insulator disposed between the mating contact portion of the adjacent wafers.

4. An electrical connector assembly comprising:

a) a first electrical connector, comprising:

i) a first support member;

ii) a plurality of wafers, held in parallel to the first support member, each wafer having a plurality of signal conductors with mating contact portions held in a line, each signal conductor having a first width;

iii) a first plurality of power conductors held to the first support member, each having a second width greater than the first width, each said power conductor bent at a right angle; and b) a second electrical connector, adapted to mate to the first electrical connector, comprising:

i) a second support member;

ii) a second plurality of wafers, held in parallel to the support member, each wafer having a plurality of signal conductors with mating contact portions held in a line;

iii) a second plurality of power conductors held to the second support member, each said power conductor bent at a right angle.

5. The electrical connector of claim 4 wherein the first plurality of wafers holds the signal conductors in a first line in a mating plane and the second plurality of wafers holds the signal conductors in a second line in the mating plane, with the first lines and the second lines orthogonal.

6. The electrical connector of claim 4 wherein the first plurality of power conductors and the second plurality of power conductors are each held in groups, with the first plurality of power conductors held in first groups by insulative members joining groups of power conductors, the power conductors within the first groups having mating contact portions held in a first power contact line, with the first power contact line being orthogonal to the first line mating contact portions of the signal conductors.

7. The electrical connector of claim 4 wherein the first support member comprises an insulative housing.

8. The electrical connector of claim 7 wherein a) each power conductor has a first end with the mating contact portion thereon and a second end, with contact tails attached thereto; and b) the insulative housing has a plurality of slots therein, with a portion of second end of each power conductor engaged within at least one of the plurality of slots.

9. The electrical connector of claim 7 wherein the insulative housing comprises a first piece and a second piece, with the second piece slidably engaged to the first piece.

10. An electrical connector of the type that includes at least two connector pieces that mate in a mating plane, comprises:

a) a first connector having:

i) a first housing, ii) a first plurality of wafers held in parallel, each containing a plurality of right angle signal conductors having mating contact portions, and an insulative body holding the signal conductor with the mating contact portions held in a line in the mating plane, with the insulative body of each wafer connected to the first housing, iii) a first plurality of right angle power conductors, wider than the signal conductors, each connected to the first insulative housing;

b) a second connector, adapted to mate to the first connector, comprising:

i) a second housing ii) a second plurality of wafers held in parallel, each containing a plurality of right angle signal conductors having mating contact portions, and an insulative body holding the signal conductors, with the insulative body of each wafer connected to the second housing, and iii) a plurality of power wafers, each containing a plurality of right angle power conductors, wider than the signal contacts, and an insulative body holding a group of the right angle power conductors.

11. The electrical connector of claim 10 used in an electronic system having a first printed circuit board having a forward edge, with a plurality first connectors mounted along the forward edge of the first printed circuit board and a plurality of orthogonal printed circuit boards, each having a forward edge disposed orthogonal to the forward edge of the first printed circuit board, each such orthogonal board having a second connector mounted along its forward edge engaging one of the first connectors on the first printed circuit board.

12. The electrical connector of claim 10 wherein the first connector additionally comprises a cap, compliantly coupled to the first housing, wherein the mating contact portions of the signal conductors of the first plurality of wafers and the first plurality of right angle power conductors are secured to the cap, and wherein the signal conductors of the first plurality of wafers and the first plurality of right angle power conductors each include a portion secured to the first housing and include a compliant portion between the secured portion and the mating contact portion.

* * * * *